United States Patent [19]

Schweizer

[11] 3,936,062

[45] Feb. 3, 1976

[54] SKI BINDING

[75] Inventor: Gottfried Schweizer, Wien, Switzerland

[73] Assignee: Gertsch AG, Zug, Switzerland

[22] Filed: June 12, 1974

[21] Appl. No.: 478,585

[30] Foreign Application Priority Data

June 29, 1973 Austria ..... 5785/73

[52] U.S. Cl. ..... 280/11.35 D

[51] Int. Cl.[2] ..... A63C 9/08

[58] Field of Search ..... 280/11.35 D, 11.35 E, 11.35 A, 280/11.35 K, 11.35 R, 11.35 B, 11.35 T, 11.35 C, 11.35 H, 11.3, 7.13; 36/2.5 AL, 2.5 A, 2.5 AB

[56] References Cited

UNITED STATES PATENTS

| | | | |
|---|---|---|---|
| 3,606,368 | 9/1971 | Smolka et al. | 280/11.35 D |
| 3,695,623 | 10/1972 | Covinix | 280/11.35 D |
| 3,794,338 | 2/1974 | Smolka et al. | 280/11.35 T |
| 3,834,723 | 9/1974 | Erlebach | 280/11.35 D |

*Primary Examiner*—Philip Goodman
*Assistant Examiner*—Milton L. Smith
*Attorney, Agent, or Firm*—Woodhams, Blanchard and Flynn

[57] ABSTRACT

Safety ski binding. A safety ski binding is provided by providing a longitudinally aligned through opening in the sole of the ski boot substantially on the centerline thereof and positioning a rod reciprocably therein. Suitable attaching means are mounted on the ski adjacent the toe and heel positions of the ski boot. Resilient means normally hold said rod entirely or substantially within the boot sole but one end thereof, when moved against said resilience, projects from the boot sole and is detachably engageable with one of said fittings, such as the heel fitting. The other attachment, such as the toe attachment, when the boot is connected to the ski, is received into the other end of said toe opening to engage the adjacent end of said rod and urge it against said resilience to extend the first-mentioned end thereof as above described to enable it to engage the first-mentioned attachment. Various modifications of this arrangement are also suggested.

4 Claims, 7 Drawing Figures

SKI BINDING

FIELD OF THE INVENTION

The invention relates to a ski binding comprising at least one fitting provided on the sole of the boot and one binding part which engages the fitting through spring-loaded holding means.

BACKGROUND OF THE INVENTION

Such fittings, when not associated with the binding, are always exposed to outside influences, like ice, snow, dirt or the like, for example, during walking. Further the fittings can be damaged during walking or during a fall when the ski boot is released from the ski. When such occurs, it may no longer be possible to effect a proper fastening of the ski boot onto the ski.

SUMMARY OF THE INVENTION

The invention accordingly endeavors to avoid these disadvantages and is characterized in that the fitting is arranged on a push rod which is supported movably in the ski boot sole against the force of a spring and wherein the fitting normally lies in a non-use position within the ski boot sole. Thus the fitting, when not in use, no longer projects beyond the edge of the ski boot sole and is accordingly substantially protected against outside influences, especially the possibilities of damage above mentioned.

BRIEF DESCRIPTION OF THE DRAWINGS

The subject matter of the invention is illustrated exemplarily in several embodiments in the drawings, in which.

DETAILED DESCRIPTION

Figure 1:
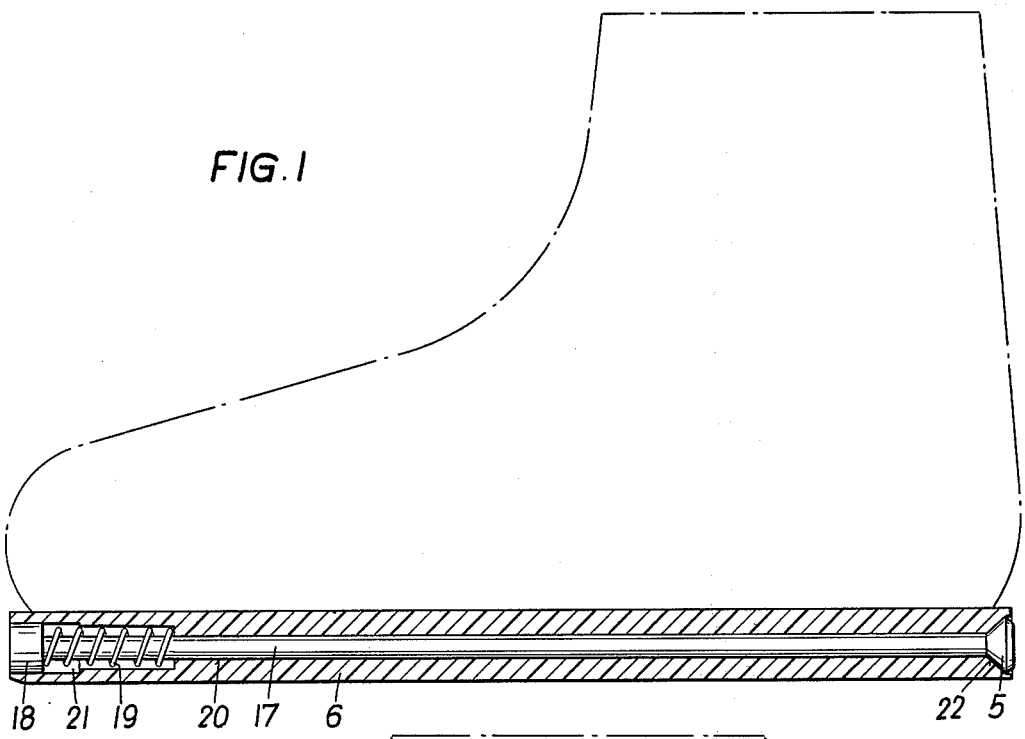
FIG. 1 illustrates a ski boot.
Figure 2:
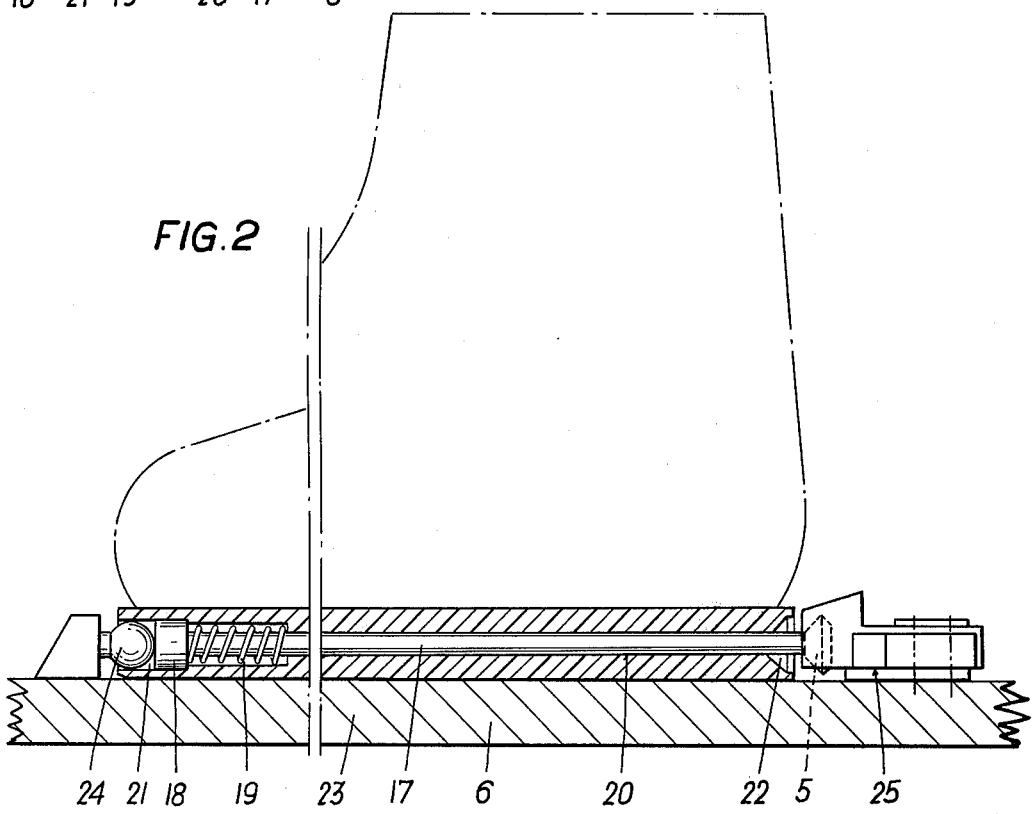
FIG. 2 illustrates the ski boot with fastening mechanisms on the ski.

As shown in FIGS. 1 and 2, a push rod 17 carries the fitting 5 on one end, here the heel end, and is supported reciprocably in a hole 20 in the ski boot sole 6. The push rod 17 has at the other end, here the toe end, an enlarged head 18 on which a spring 19 is supported and which is guided in an enlargement 21 of the hole 20. The spring 19 urges the push rod forwardly so that the fitting 5 is retracted into the recess 22 of the hole 20. Thus during walking, storing, etc., no parts project from the ski boot sole 6 which could be damaged during walking, transporting, storage, etc.

For skiing, the ski boot is moved with the tip against an attachment 24 with the heel lifted slightly above the ski. The ball-shaped attachment 24 contacts the enlarged head 18 and moves same, together with the push rod 17 and the fitting 5, backwardly against the force of the spring 19. This movement is limited by the end of the enlarged opening 21 against which end the enlarged head 18 abuts. The fitting 5 now projects over the rear part of the ski boot sole 6 and the heel can be lowered. The rear binding part 25 engages the fitting 5 and thus holds the ski boot on the ski 23. The ball-shaped attachment 24 prevents lifting of the ski boot tip and permits the rear part of the ski boot to swing upwardly and sidewardly if an overload causes the rear binding part 25 to release the fitting 5. As soon as the fitting 5 is free from the rear binding part 25, the ski boot can move from the attachment 24 and the spring 19 then automatically retracts the fitting 5 so that in this construction even after a fall, the danger of damage to the fitting is avoided.

Various suitable known bindings can be used as the rear binding part 25. An exemplary construction consists, according to FIGS. 3 to 6, substantially of two levers 1, 2 which are loaded by the springs 3, 4 and which with their bent ends grip the boot fitting 5 both from the side and from above. The springs 3, 4 resiliently hold the levers 1, 2 on two pins 7, 8 which are fixed onto the base plate 9. In order to prevent a lifting of the entire binding, a disk 10 is secured on the upper end of the pins 7, 8. The springs 3, 4 are held in and by the ends of support arms 11, 12 which are supported with their other ends on the levers 1, 2. The support arms 11, 12 are mounted at central portions thereof by the screw 14 and the nut 13 onto the levers 1, 2.

Figure 3:
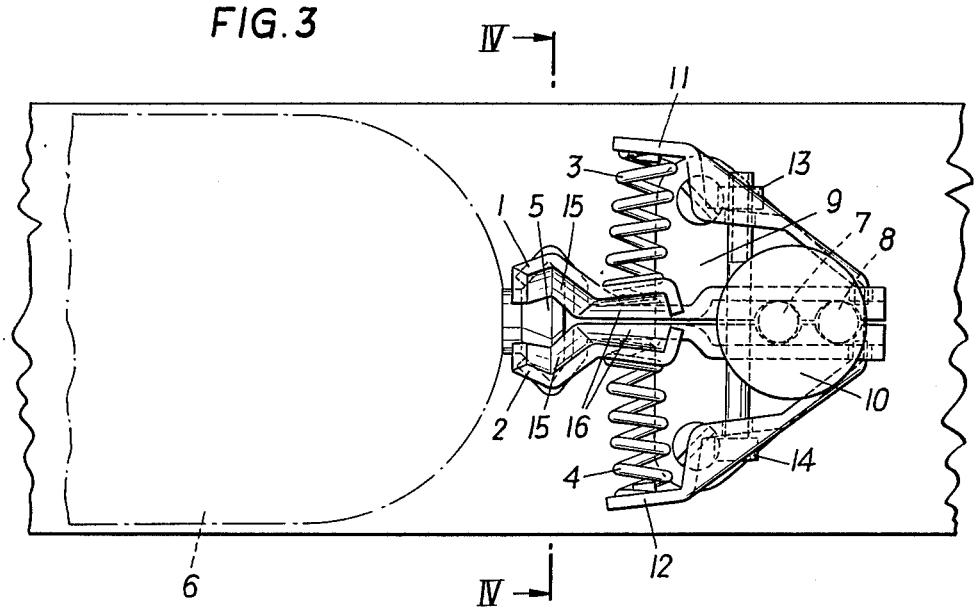
FIG. 3 is a top view of the rear holding means.
Figure 4:
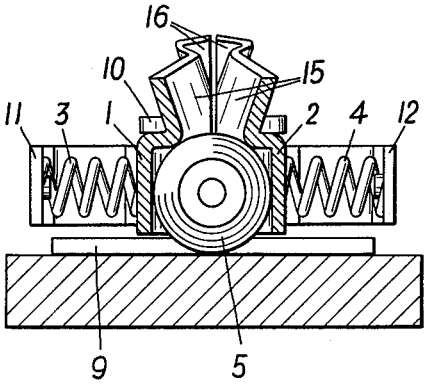
FIG. 4 is a cross-sectional view along the line IV—IV of FIG. 3.
Figure 5:
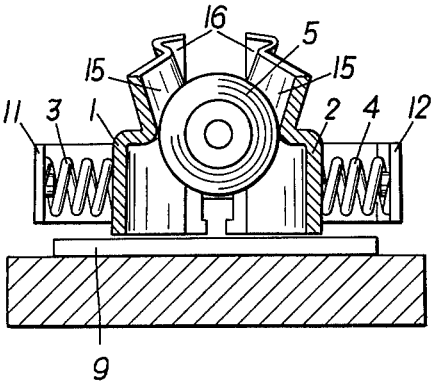
FIg. 5 illustrates the same cross-sectional view as FIG. 4 with the binding parts slightly opened.

The upper release edges of the levers 1, 2 define a trough-shaped enlargement 15 in the zone where they grip over the boot fitting 5. When the user steps into the binding, the boot is first placed in such a manner that the fitting is caused to lie above this trough-shaped enlargement 15 and then the boot is moved down. This causes the levers 1, 2 to be pressed apart, as illustrated in FIG. 5, and the fitting then reaches the holding position, as shown in FIGS. 3 and 4. Further, the levers 1, 2 also form a receiving means 16 for the ski pole. If the ski pole is introduced into this receiving means, the levers 1, 2 can be pressed apart and the fitting released from the binding. The user can then easily step out.

Figure 6:
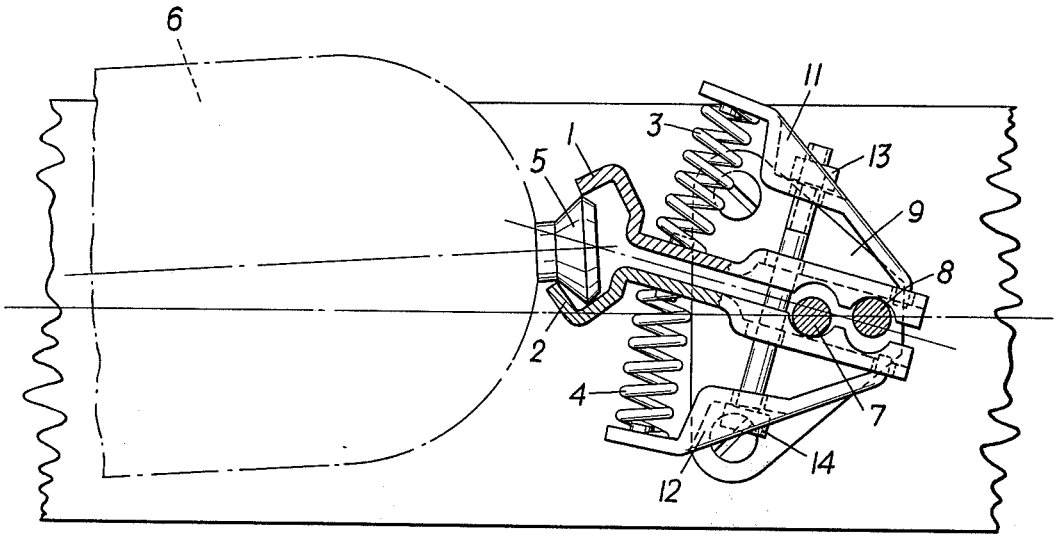
FIG. 6 is a top view of a position during a lateral twisting release.

If a twisting fall occurs, the boot sole 6 moves to the side and the levers 1, 2 are correspondingly displaced. They are supported on the pins 7, 8 and are pressed apart against the force of the springs 3, 4, as best shown in FIG. 6, which illustrates the moment of release. If a force occurs in upward direction, for example due to a fall forwardly, then the fitting 5 is moved upwardly and the two levers 1, 2 are also pressed apart, as shown in FIG. 5, which illustrates the moment of the release upwardly. The trough-shaped enlargement 15 also helps during the release to assure that the fitting is released in that when same has moved upward a given distance, it is then actually urged upwardly by the edges of the trough-shaped enlargement.

Figure 7:
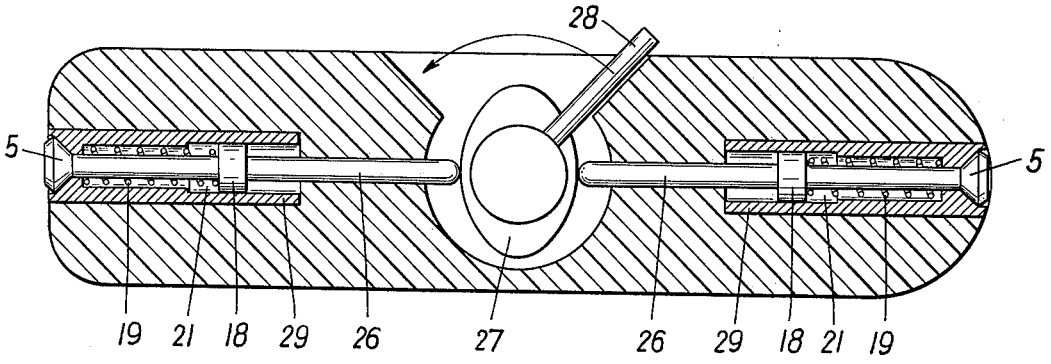
FIG. 7 is a cross-sectional view of a ski boot sole.

In the construction of FIG. 7 two fittings 5 are provided which can be respectively engaged by binding parts which are mounted on the ski both in front of and behind the ski boot sole. Each of the fittings 5 is arranged retractably on a push rod 26 positioned at least partially within the sleeves 29 which are embedded in the ski boot sole 6. The push rods 26 are urged by springs 19 against a cam plate 27 which is supported rotatably approximately in the center of the ski boot sole 6. The springs 19 are here supported each on an enlarged head 18 of the push rods 26.

In the illustrated position the two fittings 5 are retracted, so that no parts which project beyond the ski boot sole are exposed to any outside influences, damage or the like. By shifting the lever 28, the cam plate 27 is rotated which moves the push rods 26 outwardly against the force of the springs 19. The fittings 5 project in this position beyond the ski boot sole 6 and can be engaged by appropriate binding means. To limit the extension of the fittings 5 from the sleeves 29, the enlarged head 18 of each push rod 26 abuts the end of the enlarged bore 21.

The invention is not limited to the illustrated exemplary embodiments but instead further possible embodiments exist which lie within the scope of the invention. The fittings may have various suitable shapes and may cooperate with correspondingly associated binding parts. For example, it is possible to provide in place of a ball-shaped attachment in FIG. 2, a conical attachment which also makes possible a swivelling motion about the attachment at least up to the point of release by the rear binding part. Further, the forward and rearward positioning of the parts shown in FIGS. 1 and 2 may be reversed, if desired.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a ski binding arrangement having at least one fitting on a ski boot sole and one binding part having spring-loaded holding parts mounted on a ski and adapted to engage said fitting, the improvement comprising a push rod reciprocally mounted in said ski boot sole, said fitting being mounted on said push rod, resilient means for resiliently biasing said fitting into a retracted non-use position in said ski boot sole when said ski boot sole is free of engagement with said ski so that said fitting will not be extended from said ski boot sole during a use of the ski boot away from said ski, and attachment means mounted on said ski and spaced from said binding part for pushing said push rod against the urging of said resilient means to push said fitting out from said ski boot sole to a position of use when said ski boot sole engages said ski between said attachment means and said binding part.

2. An improved ski binding according to claim 1, wherein an end of said push rod remote from said fitting engages said attachment means secured on said ski, said attachment means, when said ski boot sole is in a position of use, being at the end of said ski boot sole remote from said binding part, said end of said push rod being pushed inwardly of said ski boot sole by said attachment means to effect an ejection of said fitting from within said ski boot sole.

3. An improved ski binding according to claim 1, wherein said attachment means is constructed ball-shaped and is received in a recess in said ski boot sole to hold one end of said ski boot sole remote from said binding part to said ski.

4. In a ski binding arrangement having a fitting on each end of a ski boot sole and binding parts having spring-loaded holding parts mounted on a ski and adapted to engage said fittings, the improvement comprising a push rod attached to each fitting and being reciprocally mounted in said ski boot sole, resilient means for resiliently biasing each of said fittings into a retracted non-use position in said ski boot sole when said ski boot sole is free of engagement with said ski so that said fittings will not be extended from said ski boot sole during a use of the ski boot away from said ski, and a rotatably supported cam plate on said ski boot engaging said inner ends of each of said push rods so that a rotation of said cam plate will effect a projection of said fittings from said ski boot sole against said biasing of said resilient means.

* * * * *